United States Patent [19]

Glang

[11] Patent Number: 4,797,032

[45] Date of Patent: Jan. 10, 1989

[54] SEALING PROFILE

[75] Inventor: Siegfried Glang, Hamburg, Fed. Rep. of Germany

[73] Assignee: Phoenix Aktiengelsellschaft, Harburg, Fed. Rep. of Germany

[21] Appl. No.: 147,114

[22] Filed: Jan. 21, 1988

Related U.S. Application Data

[63] Continuation of Ser. No. 912,313, Sep. 29, 1986, abandoned, which is a continuation-in-part of Ser. No. 865,690, May 22, 1986, abandoned.

[30] Foreign Application Priority Data

Jul. 20, 1985 [DE] Fed. Rep. of Germany ..... 3526063

[51] Int. Cl.[4] ..... E21D 11/38; E04B 1/68; E16J 15/02

[52] U.S. Cl. ..... 405/152; 405/151; 52/396; 277/208

[58] Field of Search ..... 405/134, 135, 146, 147, 405/150–153; 52/393, 396, 403; 277/207 R, 208; 404/64–69

[56] References Cited

U.S. PATENT DOCUMENTS

| | | | |
|---|---|---|---|
| 2,615,741 | 10/1952 | Nathan | 277/208 |
| 3,695,044 | 10/1972 | Hoshino et al. | 405/152 |
| 4,195,850 | 4/1980 | Berger et al. | 405/135 X |
| 4,199,158 | 4/1980 | de Munck | 405/135 X |

FOREIGN PATENT DOCUMENTS

| | | | |
|---|---|---|---|
| 2513365 | 10/1976 | Fed. Rep. of Germany | 405/152 |
| 2833345 | 2/1980 | Fed. Rep. of Germany | 405/152 |
| 3008711 | 9/1981 | Fed. Rep. of Germany | 405/153 |
| 2121457 | 12/1983 | United Kingdom | 405/153 |

*Primary Examiner*—Randolph A. Reese
*Assistant Examiner*—John A. Ricci
*Attorney, Agent, or Firm*—Collard, Roe & Galgano

[57] ABSTRACT

A sealing profile made of rubber or rubber-like material, for sealing tubular tunnel segments provided with a recess extending therearound at their edges. The base surface of the profile has 4, 5, or 6 grooves extending parallel to each other in the longitudinal direction. Correspondingly, on top of the grooves are 3, 4, or 5 ducts, respectively, which are displaced sideways with respect to the grooves. The ducts also extend parallel in the longitudinal direction of the profile. The base surface of the profile has a plane surface and the grooves are identically shaped and arranged with equal spacings between each other. The ducts disposed above the grooves also have the same spacing between each other. The wall thickness of the profile is nearly everywhere equal, and the lateral sides of the profile are inclined with an angle of 10° to 20°.

10 Claims, 2 Drawing Sheets

SEALING PROFILE

REFERENCE TO RELATED APPLICATION

This is a continuation application of application Ser. No. 912,313, filed Sept. 29, 1986, for "SEALING PROFILE", now abandoned, which in turn is a continuation-in-part application of application Ser. No. 865,690, filed May 22, 1986, entitled "SEALING PROFILE", now abandoned, the subject matter which is expressly incorporated herein.

BACKGROUND OF THE INVENTION

The invention relates to a sealing profile for sealing tunnel segments. More particularly it relates to a rubber or rubber-like sealing profile for sealing tunnel segments made of, e.g., concrete, steel reinforced concrete, cast iron, or steel pipe, which have recesses at their edges for mounting the profile.

Such a sealing profile is disclosed in DE-PS No. 28 33 345, and has been successfully used in tunnel construction and shaft installations using segments or tubings made of concrete, steel, or steel reinforced concrete However, further developments in the construction of tubes for tunnels and the like have resulted in additional requirements which such sealing profiles made of rubber or rubber-like material must satisfy. It is desirable that the sealing profiles be kept narrow in relation to the wall thickness of the segments without, however, reducing the areas of contact of the sealing profiles. A large supporting surface must be maintained for the segments in order to avoid increased stressing of the segments. Furthermore, profiles used for these purposes are expected to withstand stresses or effects caused by solvents, oils, and greases, so that the adherence or glueing of the profile into the recess of the segment remains sufficient to reliably secure it in place. Moreover, the wall thickness varies within this known profile, resulting in an unfavorable distribution of forces and stresses therein. In addition, the positive volume of the profile resting in the recess of the segment should be such that the profile is fully accommodated in the recess when the segments are compressed.

Accordingly, it is an object of the invention to provide an improved sealing profile of the above-specified type which permits a uniform deformation of all sections of the profile, in combination with secure glueing and a relatively narrow width or minimal volume.

SUMMARY OF THE INVENTION

The foregoing and related objects are readily attained, according to the invention, by providing a sealing profile as described above having n-number of substantially identically-shaped parallel grooves (n=4, 5, 6) disposed in a base section having a planar base surface, with the grooves positioned therein with equal lateral spacings between each other. The grooves extend in a direction parallel to the longitudinal axis of the profile. Disposed above the grooves in a top section integral with the base section are m-number of parallel ducts (m=3, 4, 5) also with equal lateral spacings between each other. The ducts also extend in a direction parallel to the longitudinal axis of the profile and are at least partially laterally displaced with respect to the grooves. The number of ducts in the profile is equal to one less than the number of grooves therein. The grooves and ducts also have an approximately equal spacing between each other, such that the wall thickness between each of, or any one of these spaces, is everywhere almost uniform or even, i.e., the profile is provided with nearly identical wall thickness at all points. In addition, the lateral sides of the profile base are set back or inclined and extend from the base surface with an angle of from 10 to 20 degreees. Preferably, the plane of maximum width of the profile defines the plane of separation between the top and base sections, and the width of the base surface is approximately 70–80% of the maximum width of the profile.

When the profiles according to the invention, resting back to back in the recesses in the segments, are compressed, the rubber mass is first slightly displaced in the direction of the center of the profile due to the angular setting on tne sides. In the course of this displacement, however, the profile does not lift from the marginal surface or edge surface of the recess, so that the glued connection between the profile and the segment is securely maintained. Due to the novel design of the profile with its 4, 5, or 6 grooves with the corresponding number of 3, 4, or 5 ducts, and the nearly equal wall thicknesses separating them, the compressive forces within the profile are directed to minimize the stresses in the profile material. Secure and reliable glueing of the profiles on the bottom and sides of the segment recesses is important because rough surfaces of the segments may lead to leaks or loose areas in the recess. In profiles having 3 grooves and 2 ducts, and in profiles having more than 6 grooves, and correspondingly more than 5 ducts, the force and stress distribution or force-path behavior, is significantly less favorable than in the profile of the invention, which has from 4–6 grooves and 3–5 ducts.

The profile according to the invention (also referred to as a small sealing profile for tubings) has a weight of only about 203 g/m. This is significantly lighter than the conventional profile, a result attributed to the larger volume of the hollow space within the profile, among other factors.

Another important advantage of the present invention is that a largely uniform deformation of all sections of the profile is achieved on compression, due to the design of the profile and its edge shape. Since such rubber profiles remain in the deformed state over decades, it is important that this long term deformation does not lead to damage of the profile. The largely uniform deformation of all sections of the profile permits a broader range of variation in the manufacture of the profile rubber blend. It is therefore possible to use rubber mixtures which can satisfy other requirements. For example, a rubber blend consisting of a mixture based on polychloroprene or nitrile rubber may be preferred if contact with chemically aggressive gases or liquids is expected. Furthermore, high resistance to aging in the deformed state is also an important secondary consideration. However, high resistance to aging may be achieved also by using a mixture based on EPDM (ethylenepropylene-diene rubber). Preferably, the rubber has a Shore A-hardness of from 40–70.

Other objects and features of the present invention will become apparent from the following detailed description considered in connection with the accompanying drawings, which disclose one embodiment of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

DESCRIPTION OF THE PREFERRED EMBODIMENT

Figure 1:
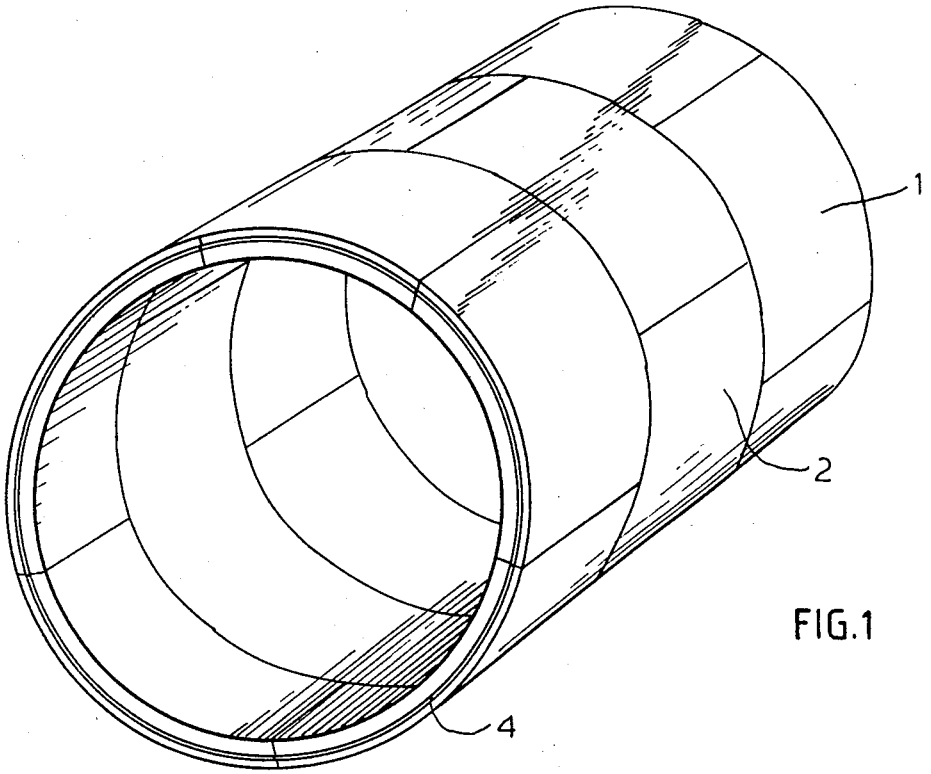
FIG. 1 is a front perspective view of a pipe section formed by a plurality of tunnel pipe segments.
Figure 2:
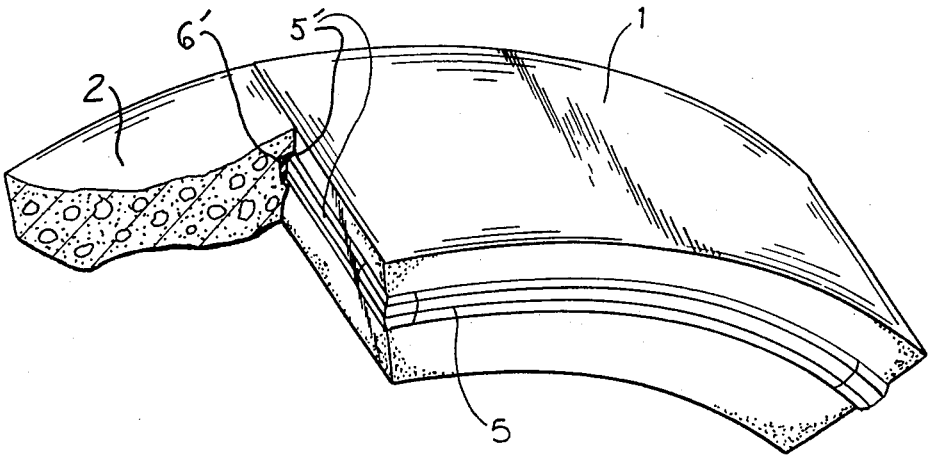
FIG. 2 is a fragmentary front perspective view of two annularly adjacent tunnel pipe segments with the sealing profile of the invention mounted therein.

Turning now in detail to the appended drawings, therein illustrated is a novel sealing profile embodying the present invention, wherein, as shown in FIG. 1, a plurality of tunnel segments, e.g., 1 and 2 are sealed against each other, via abutting sealing profiles thereby forming a sealed tunnel or pipe section. FIG. 2 further illustrates a sealing profile 5 in the uncompressed state mounted onto a tunnel segment 1. FIG. 2 also shows the engagement of two assembled tunnel segments, i.e., segments 1 and 2, and the resulting compression of their respective profiles into compressed profiles 5' and 6'.

Figure 3:
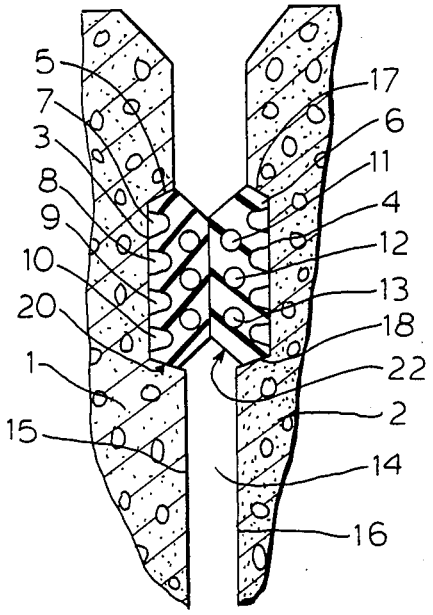
FIG. 3 is a fragmentarily-illustrated sectional view of two tunnel segments with the sealing profiles of the invention arranged in the tunnel segment recesses, in the state prior to compression.

As shown in FIG. 3, each of the two tunnel segments 1 and 2 has a recess 3 and 4, respectively. The two sealing profiles 5 and 6 are adhered, as by gluing into the recesses back to back. Each sealing profile 5, 6 comprises a base section 20, and a top section 22. Base section 20 has a cross sectional shape generally in the form of an isosceles trapezoid with its shorter parallel side being substantially planar and forming the base surface of the sealing profile. Lateral base sides 17 and 18 of base section 20 are disposed at an angle of from 10 to 20 degrees with respect to a plane perpendicular to the base surface. In the embodiment illustrated in the drawing, lateral base sides 17 and 18 are disposed at an angle of 15 degrees with respect to this plane. Top section 22 may also be generally of an isosceles trapezoidal cross section shape with its longer parallel side integral with the longer parallel side of the base section, therein defining a "plane of separation" between the sections.

Sealing profiles 5 and 6 have four substantially identically shaped laterally spaced apart grooves 7, 8, 9 and 10 provided on the base side thereof. Grooves 7–10, which may have a curved shape, extended parallel to each other in a direction parallel to the circular longitudinal axis of the profile. Furthermore, the profile includes three laterally and equally spaced apart parallel ducts 11, 12 and 13 in base section 20 extending in a direction parallel to the longitudinal axis of the profile. The ducts are laterally displaced with respect to grooves 7–10. Both the grooves and ducts have identical spacings between each other. Alternate embodiments of the profile have 5 grooves and 4 ducts, or 6 grooves and 5 ducts.

Referring once again to FIG. 3, as profiles 5 and 6 are pressed together within zone 14, as when segments 1 and 2 are mechanically joined together, e.g., with bolts, the rubber mass of each profile is displaced into its associated recess 3 or 4. In the final state, the edges 15 and 16 of segments 1 and 2 are firmly abutting. The rubber mass previously disposed above recesses 3 or 4 is now largely evenly deformed in such a way that no peak stresses are created in the profile rubber material. The contact pressure between the backs of profiles 5 and 6 is also largely uniform.

Figure 4:
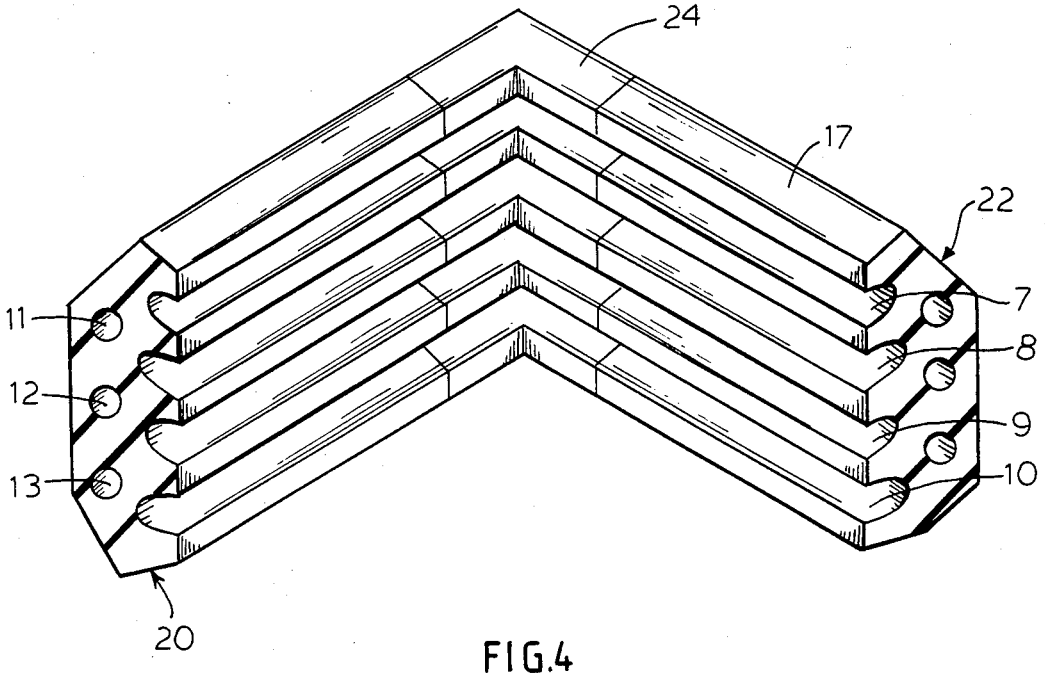
FIG. 4 is a fragmentarily-illustrated front perspective view of a preferred embodiment of a sealing profile corner section.

As illustrated in FIGS. 2 and 4, the sealing profile may be comprised of four individual profile pieces which are joined at the corners to form a profile frame dimensioned to match the peripheral recess in the tunnel segments. The frame corners, designated 24, joining each of the individual profile pieces may be produced by the injection molding process.

Thus, while only a single embodiment has been shown and described, it is obvious that many changes and modifications may be made thereunto, without departing from the spirit and scope of the invention.

What is claimed is:

1. A sealing profile for sealing segments of a tunnel tube having an edge recess therearound, comprising:

a base section having a substantially planar base surface including from 4 to 6 substantially uniform, laterally and equally spaced-apart parallel grooves, extending in a direction parallel to the longitudinal axis of said profile, and lateral sides extending from said base surface divergently inclined from one another at an angle of from 10 to 20 degrees with respect to a plane perpendicular to said base surface; and a top section, integral with said base section, having a number of laterally and equally spaced apart parallel ducts equal to one less than the number of said grooves, said ducts extending in a direction parallel to the longitudinal axis of sia profile, said ducts being at least partially laterally displaced with respect to said grooves, the wall thicknesses of the profile material between any of said grooves and ducts all being substantially equal.

2. The sealing profile according to claim 1, wherein said lateral sides are inclined at an angle of 15 degrees with repsect to a plane perpendicular to said base surface.

3. The sealing profile according to claim 1, wherein the plane of the maximum width of the profile defines the plane of separation between said top and base sections.

4. The sealing profile according to claim 1 wherein the width of said planar base surface is approximately 70 to 80% of the maximum width of said profile.

5. The sealing profile according to claim 1, wherein said sealing profile consists of rubber

6. The sealing profile according to claim 5, wherein said sealing profile is made of a rubber mixture based on a member selected from the group consisting of polychloroprene, EPDM, and nitrile rubber, and a combination thereof.

7. The sealing profile according to claim 5, wherein said profile has a Shore A-hardness in the range of about 40 to 70.

8. The sealing profile according to claim 1, wherein said profile is made of a rubber-like material

9. The sealing profile according to claim 1, wherein said sealing profile includes a four corner frame comprising four individual profile sections, and injection molded frame corners joining the ends of said profile sections.

10. The sealing profile according to claim 1, comprising four parallel grooves in said base section, and three parallel ducts in said top section.

* * * * *